US006045601A

United States Patent [19]

Tan

[11] Patent Number: 6,045,601

[45] Date of Patent: Apr. 4, 2000

[54] NON-MAGNETIC, HIGH DENSITY ALLOY

[75] Inventor: Lye King Tan, Singapore, Singapore

[73] Assignee: Advanced Materials Technologies, Pte, Ltd., Singapore, Singapore

[21] Appl. No.: 09/392,390

[22] Filed: Sep. 9, 1999

[51] Int. Cl.[7] ..... C22C 1/04; C22C 27/04

[52] U.S. Cl. ..... 75/248; 420/430; 419/8; 419/23; 419/26; 419/37; 419/46; 419/54

[58] Field of Search ..... 420/430; 419/8, 419/23, 26, 37, 46, 54; 75/248

[56] References Cited

U.S. PATENT DOCUMENTS

| | | | |
|---|---|---|---|
| H1075 | 7/1992 | Kapoor | 420/430 |
| 4,990,195 | 2/1991 | Spencer et al. | 148/11.5 F |
| 5,145,512 | 9/1992 | Spencer | 75/248 |
| 5,294,269 | 3/1994 | Lee et al. | 148/514 |
| 5,686,676 | 11/1997 | Jech et al. | 75/247 |
| 5,821,441 | 10/1998 | Kawamura | 75/248 |
| 5,831,188 | 11/1998 | Amick et al. | 75/246 |
| 5,889,220 | 3/1999 | Akiyoshi et al. | 75/248 |

*Primary Examiner*—Daniel J. Jenkins
*Attorney, Agent, or Firm*—George O. Saile; Stephen B. Ackerman

[57] ABSTRACT

A high density, non-magnetic alloy is described along with a process for manufacturing it. The preferred composition for the alloy is approximately 95% by weight of tungsten and 5% of austenitic stainless steel. The process for manufacturing the alloy begins with blending tungsten and stainless steel powders which are then mixed with an organic binder to form a feedstock. The latter is then molded into the form of compacted items, such as a hard drive counterweight balance, and then sintered in either vacuum or a hydrogen atmosphere. The tungsten heavy alloys of the present invention can be easily manufactured in large volume economically in many intricate shapes with excellent control of weight and dimensions.

20 Claims, 2 Drawing Sheets

NON-MAGNETIC, HIGH DENSITY ALLOY

FIELD OF THE INVENTION

The invention relates to heavy tungsten/stainless steel alloys having a novel combination of non-magnetic properties and high density, with particular reference to forming them into complex shaped articles.

BACKGROUND OF THE INVENTION

Tungsten-based alloys (termed heavy alloys) are commonly used in applications such as kinetic energy penetrators, hard disk drive balance weights, nuclear and medical radiation shields, high voltage electric contacts and electrodes. These materials have one very important and desirable attribute, namely high density, which is not commonly found in other metal alloys.

For kinetic energy penetrators, generally, the higher the density of the material, the greater the desired penetration. For hard disk drive counterweights, the purpose is to concentrate the maximum possible weight in the smallest possible space so as to miniaturize the volume occupied in a disk drive. For nuclear and medical radiation shields, higher density results in higher absorption of X-rays and gamma radiation. For high voltage electric contacts and electrodes, the high melting temperature and arc erosion resistance of tungsten allow for longer life span. Thus, tungsten heavy alloys in various shapes can be used economically in many important applications. However, most of the high density materials (densities greater than 16 or 17 g/cc) such as gold, rhenium, platinum, iridium and uranium are either very expensive or extremely difficult to process.

Several tungsten heavy alloy compositions have been described in the prior art. Classic conventional alloys of tungsten-nickel-iron (e.g. U.S. Pat. No. 5,145,512, entitled "Tungsten nickel iron alloys") have been widely used in commercial and defense applications because of their unique properties of high density, high strength and high ductility. Another typical alloy is tungsten-copper (e.g. U.S. Pat. No. 5,889,220 entitled "Copper-tungsten alloys and their manufacturing methods" and U.S. Pat. No. 5,686,676 entitled "Process for making improved copper-tungsten composites") which is commonly used in electrical applications because of the special combined properties of low electrical resistivity and high arc erosion resistance.

While these alloys provide unique properties in their own right, they are either magnetic or have low electrical resistivity. These properties limit their application in the areas where magnetic properties and/or low electrical resistivity are undesirable, such as counterweight balances in disk drive actuator arms.

A routine search was performed for alloys in which the major component was tungsten and in which some iron and possibly chromium were also present. No references describing compositions that approximate those taught by the present invention were found. About the closest was U.S. Pat. No. 5,821,441 (Kawamura October 1998) which discloses an alloy having between about 80 and 97% by weight tungsten, with the remainder being nickel, cobalt, copper, and optionally iron (in concentrations up to 5%). The alloy is also prepared by sintering, its main characteristic being a high level of corrosion resistance.

SUMMARY OF THE INVENTION

It has been an object of the present invention to provide an inexpensive high density alloy that can be used for a variety of purposes.

Another object of the invention is that said high density alloy have unit magnetic permeability.

Still another object of the invention has been to provide a process for manufacturing the non-magnetic tungsten heavy alloy.

A further object of the invention has been that said process be based on conventional powder metallurgy and be suitable for applying a metal injection molding process economically.

A still further object has been that said process be adaptable for mass volume production with flexibility in geometry and consistency of weight and dimensions.

These objects have been achieved by mixing tungsten (present in an amount of at least 75% by weight) with austenitic stainless steel. The preferred composition has been approximately 95% by weight of tungsten and 5% of austenitic stainless steel with a sintering temperature between 1450 and 1500° C. in a vacuum of <0.01 torr and a sintering time of approximately 60 minutes.

The process for producing the tungsten heavy alloy essentially comprises the steps of mixing a composition of elemental powders into feed stock that includes tungsten in the amount of at least 75% by weight, the remainder being austenitic stainless steel in an amount sufficient for the required density and strength.

The process includes molding the feedstock into the form of compacted items, such as a counterweight balance, and then sintering in either vacuum or a hydrogen atmosphere. The technical advantage of the tungsten-based heavy alloy of the present invention is that the source materials for the alloys are readily available. Austenitic stainless steel and tungsten powder are easy to buy from powder manufacturers worldwide.

The tungsten heavy alloys of the present invention can be easily manufactured in large volume economically in many intricate shapes with excellent control of weight and dimensions.

Another technical advantage of the present invention is that the heavy alloy is non-magnetic. As a result, it is not subject to any magnetic attraction force when the alloy is in a magnetic field. Hence it has the potential to be used as high density counterweight balance in disk drive actuator arms and electric motors. Further, it has higher electrical resistivity than tungsten copper alloys, of equal tungsten composition, making it useful for less sensitive electrical applications.

DESCRIPTION OF THE PREFERRED EMBODIMENTS

Figure 1:
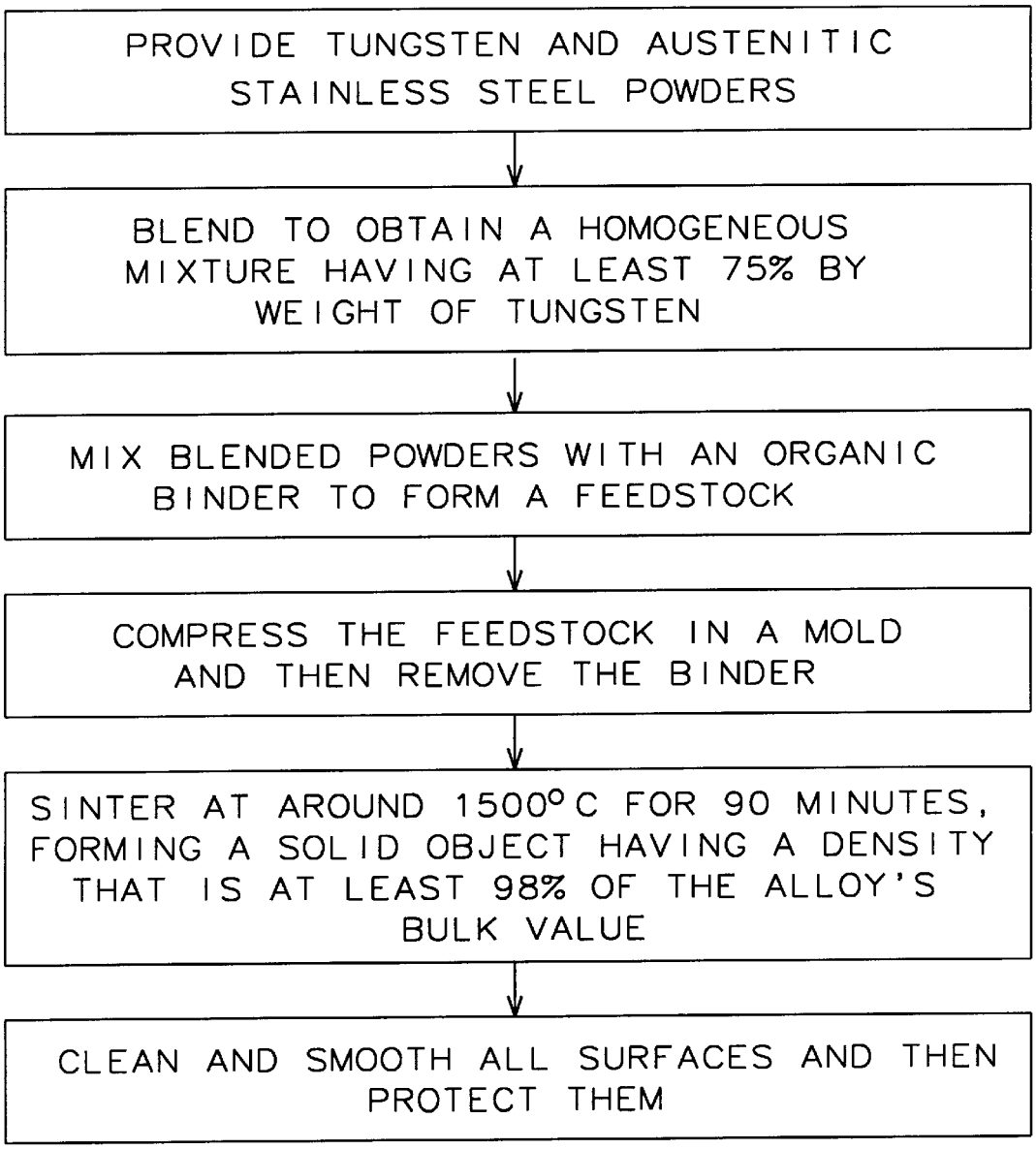
FIG. 1 is a flow chart summarizing the process of the present invention.

The preferred composition (by weight percent) of the tungsten-heavy alloy of the present invention is tungsten 95%, and Austenitic Stainless Steel (all types) 5%, but good results will still be obtained if tungsten is present in concentrations between 75–98%. These alloys are characterized by being of high density, having unit magnetic permeability, and having relatively high electrical resistivity.

The tungsten and stainless steel powders are produced using conventional techniques such as, but not limited to, gas atomization or water atomization. The general particle sizes of the resulting metal powders are typical of those used in powder metallurgy and powder injection molding (for example, 50 microns or less). The selection of the specific metal powder size is, however, important, as will be appreciated by those skilled in the art of powder metallurgy and powder injection molding. The metal powder size, including powder size distribution, has a definite effect on the properties of the end products that are obtained. Therefore, the metal powder size and powder size distribution used in the present invention were selected so as to impart maximum density and other desirable properties to the alloys produced. Preferably, the powders should have a mean particle size between about 0.8 and 1.8 microns for tungsten and a mean particle size between about 10 and 25 microns for stainless steel.

Tungsten and stainless steel powders are available commercially in these particle size ranges. They are also commercially available in larger particle size ranges. Metal powder having the above composition (as taught by the present invention) is then mixed with a plasticizer (also known as a binder) to form feedstock which can be compacted by means of heavy tonnage presses and injection molded by means of conventional injection molding machines. As is well known to those skilled in the art, organic polymeric binders are typically included in molded articles (and will be debinded prior to sintering) for the purpose of holding the articles together. An organic polymeric binder is similarly included in the articles used in the present invention for the same purpose.

Essentially any organic material which will function as a binder and which will decompose at elevated temperatures, without leaving an undesirable residue detrimental to the properties of the metal articles, can be used in the present invention. Preferred materials include various organic polymer such as stearic acids, micropulvar wax, paraffin wax and polyethylene.

The above feedstock is then either compacted or injection molded. For example, the metal powder can be injection molded using conventional injection molding machines to form green articles. The dimensions of the green articles depend on the dimensions of the desired finished articles, after taking into account the shrinkage of the articles during the sintering process. The metal powder can be pressed with either high tonnage hydraulic or mechanical press in a die to form the green article.

After the feedstock has been compacted or injection molded into the desired shape, which can be complex in its geometry, the binder is removed by any one of several well known debinding techniques available to the metal injection molding industry such as, but not limited to, solvent extraction, heating, catalytic action, or wicking.

The molded, or formed, articles from which the binder has been removed is then densified in a sintering step using any one of several furnace types. The preferred sintering process is carried out in a batch vacuum furnace (as it is efficient and economical), but other techniques such as, but not limited to, continuous atmosphere, or batch atmosphere could also have been used.

The selection of supporting plates for use during the sintering process is important. Alumina, or a similar material which does not decompose or react under the sintering conditions, must be used as the supporting plate for the articles in the furnace. Contamination of the metal alloys can occur if suitable plates of this type are not used. For example, a graphite plate is not usable as it reacts with the stainless steel component of the tungsten heavy alloys of the present invention.

Sintering is carried out for sufficient time and at a temperature high enough to cause the green article to be transformed into a sintered product, i.e. a product having density of at least 98% (preferably at least 99%) of the bulk value.

Sintering processes suitable for producing tungsten/stainless steel alloys require special attention to the prevention of common defects such as warpage, cracking, and non-uniform shrinkage. Sintering can be carried out in either vacuum or hydrogen atmosphere, preferably vacuum with less than 0.02 torr. The temperature is ramped up gradually from room temperature to the sintering temperature at a ramp rate of 250° C./hr to 450° C./hr. Typically the temperature is between 1400 to 1550° C. for 30 to 90 minutes. A good vacuum of less than 0.01 torr at sintering temperature will provide excellent temperature uniformity in the furnace which in turn brings about even and uniform shrinkage of the articles in a given batch.

Conditions during sintering must be carefully controlled. Too rapid a temperature ramping rate and insufficient sintering temperature and time will result in the production of tungsten heavy alloys that have poor properties in terms of density, strength, inconsistent shrinkage, fragility, and the like.

An example of a sintering profile which we have found to be particularly effective for manufacture of tungsten/stainless steel efficiently and economically involves heating the green articles in a vacuum of less than 0.01 torr from room temperature to 600° C. at a rate of temperature change of 300° C./hr and maintaining them at that temperature for about 0.5–1 hour. The ramp rate is then increased to 400° C./hr until the temperature reaches the sintering temperature of 1,450–1,500° C., and then holding it there for 30–90 minutes. The temperature is then gradually lowered until it is reduced to 800° C. at which time the articles are rapidly cooled, using inert gases such as argon or nitrogen, using the cooling fan of the furnace.

The physical dimensions and weight of the sintered tungsten heavy alloys are consistent from batch to batch. The variability of dimensions and weights within the same batch is minimal. Close tolerances of dimensions and weight can be achieved and thus eliminate the need for secondary machining processes which can be costly and difficult.

After the sintering process is completed, the tungsten heavy alloys of the present invention can be removed from the sintering furnace and used as is. Alternatively, they can be subjected to well-known, conventional secondary operations such as a glass beading process to clean the sintered surface and/or tumbling to smooth off sharp edges and remove burrs.

The tungsten heavy alloys produced in the present invention can be used in a variety of different industrial applications in the same way as prior art tungsten/nickel/iron alloys. While they may be effectively used for applications where magnetic properties and good electrical conductivity are not wanted or needed, such as counterweight balances in disk drive actuator arms, they are not limited to such applications.

The surfaces of tungsten heavy alloys can be protected with a secondary metallic coating to enhance corrosion resistance. This can be easily done, for example, by plating with nickel using conventional plating processes such as electroless nickel plating and/or electroplating. Electroless nickel plating is preferred because it produces a dense, uniform coating. Activation of the tungsten heavy alloys' surfaces can be done with a nickel strike which is a lower cost process and is thus preferred. Electroless nickel is available with various contents of phosphorous. Mid-phosphorous (about 7% P) is typically used for tungsten/stainless steel alloys because it provides the best balance between cost and performance.

If desired, the tungsten heavy alloys of the present invention can be epoxy coated, not only to protect against corrosion but also to facilitate better adhesion to other metallic surfaces.

The sintered tungsten/stainless steel of high density of the present invention can be easily and rapidly produced in large quantities as articles of intricate shape and profile. Variability in weight and physical dimension between parts within a batch is very small, which means that post sintering machining and other mechanical working can be totally eliminated.

We have summarized the manufacturing process described above in flow chart form in FIG. 1.

AN EXAMPLE

In a double-V blender machine, 22,557 g of tungsten powder having a mean particle size of 1.8 microns, 852 g of stainless steel powder (grade 316 L, atomized in argon), having a mean particle size of 15 microns, and 80 g of stearic acid were blended for 4 hours. After a homogeneous mixture had been obtained, the mixture was transferred to a mixing machine. The mixing machine was a double-planetary mixer where the bowl was heated to 150° C. using circulating oil in the double-walled bowl. The well blended powder mixture was then placed inside the bowl with an organic binder composed of 398 g of micropulvar wax, 318 g of semi-refined paraffin wax and 795 g of polyethylene alathon.

The mixture of powder and organic binders took 4.5 hours to form a homogeneous powder/binder mixture with the last 1 hour being in vacuum. The powder/binder mixture was then removed from the mixing bowl and cooled in the open air. Once it had cooled and solidified at room temperature, it was granulated to form a granulated feedstock. The density of the granulated feedstock was measured by a helium gas pycnometer and found to be identical to the bulk value.

An injection-molding machine was fitted with a mold for a rectangular block. The sintered block has a total length of 14.0×3.0×3.0 mm. Based on the expected linear sintering shrinkage of 20.5%, the mold is made to be 20.5% larger in all dimensions than the rectangular block. The injection molding composition was melted at a composition temperature of 190° C. and injected into the mold which was at 100° C. After a cooling time of about 20 seconds, the green parts were taken from the mold.

The green parts containing the metal powder were freed of all organic binder over a period of 10 hrs at 600° C. in a nitrogen atmosphere. The green rectangular block containing the binder-free metal powder was laid on an alumina supporting plate and was heated to 1,450° C. at a rate of 350° C./hr under a vacuum of less than 0.01 torr in a high temperature sintering furnace. The sintering time was 60 minutes at 1,450° C. and the sintering furnace was then cooled. This gave a rectangular block having exactly the correct dimensions.

Figure 2:
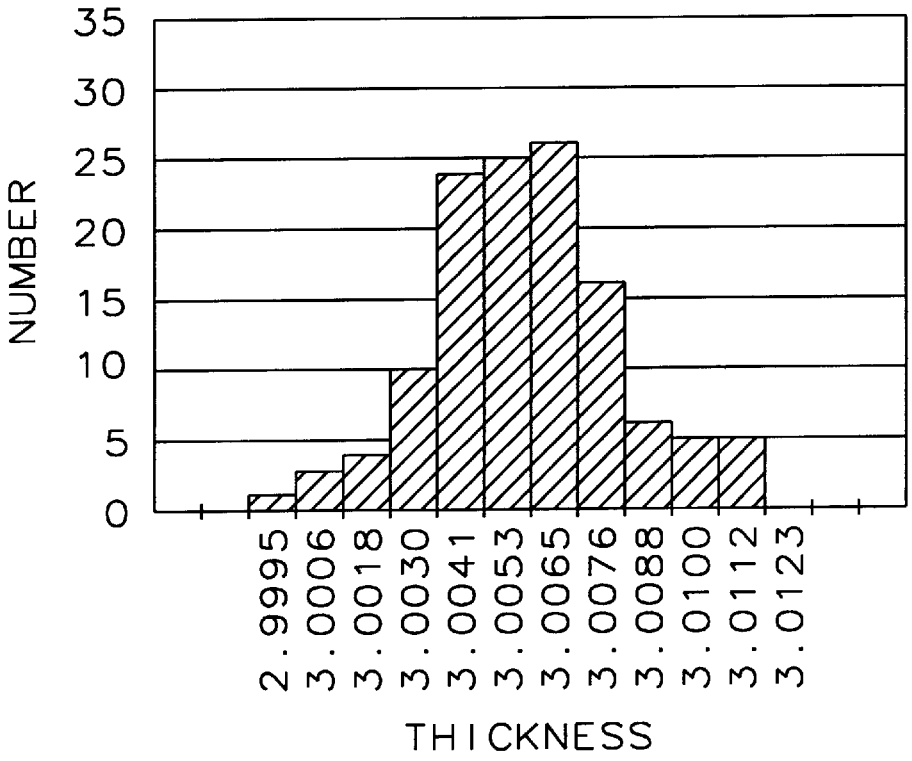
FIG. 2 is a histogram plotting number of samples within a batch that fall within a particular thickness range.

A sample of 125 pieces of rectangular block was taken in order to measure weight and thickness and a histogram to show the distributions was plotted. The results, as seen in FIG. 2, show that, for a specified thickness of 3.000 mm. the actual thicknesses ranged from 2.985 to 3.015 mm. with a mean of 3.0052 mm. The standard deviation was 0.0023 and the three sigma value was 0.0069. The Cp at 3 sigma distribution of the weight is 4.2 while the Cp of thickness dimension is 2.16. Thus the process of vacuum sintering produced tungsten/stainless alloys with excellent process control in term of weight and dimension.

When a linear tolerance of 0.5% is applied to the thickness dimension, the specification of thickness would be 3.00±0.015 mm. The Cpk would be 1.41 as seen in the histogram of FIG. 2. The density of the sintered part was measured at 18.39 g/cm$^3$ which is very close to the bulk density value of 18.5.

The magnetic permeability of the alloy was measured by a vibration sample magnetometer (VSM). The result was a value of one, meaning that the alloy of the present invention is totally non-magnetic.

While the invention has been particularly shown and described with reference to the preferred embodiments thereof, it will be understood by those skilled in the art that various changes in form and details may be made without departing from the spirit and scope of the invention.

What is claimed is:

1. A process for manufacturing a high density, non-magnetic alloy, comprising:

providing tungsten powder having a first particle size;

providing austenitic stainless steel powder having a second particle size;

mixing said powders, in weight proportions of between about 75 and 98% tungsten and between about 2 and 25% stainless steel, with a binder to form a feedstock;

compressing the feedstock and then removing the binder; and placing the powder mixture in a furnace and sintering it for a time at a temperature whereby said powder mixture becomes a non-porous solid having a density that is at least 98% of the alloy's bulk value.

2. The process of claim 1 wherein the first particle size is between about 0.6 and 10 microns.

3. The process of claim 1 wherein the second particle size is between about 5 and 40 microns.

4. The process of claim 1 wherein said sintering time is between about 0.5 and 1.5 hours.

5. The process of claim 1 wherein said sintering temperature is between about 1,400 and 1,550° C.

6. The process of claim 1 wherein said alloy has a density between about 16 and 19 gm./cc.

7. The process of claim 1 wherein said alloy has an electrical resistivity between about 5 and 7 ohm-cm.

8. A process for manufacturing a high density, non-magnetic alloy in the form of an article, comprising:

providing tungsten powder having a first particle size;

providing austenitic stainless steel powder having a second particle size;

blending the powders to obtain a homogeneous powder mixture having weight proportions of between about 75 and 98% tungsten and between about 2 and 25% stainless steel;

mixing said blended powder with a binder to form a feedstock;

compressing the feedstock in a mold to form a green article;

then removing the binder;

then, on a supporting plate, placing the green article in a furnace and sintering it, whereby said green article becomes an article having a density that at least 98% of the alloy's bulk value;

after sintering, cleaning and smoothing all surfaces of the article; and then protecting said surfaces.

9. The process of claim 8 wherein said binder is an organic polymer selected from the group consisting of stearic acids, micropulvar wax, paraffin wax, and polyethylene.

10. The process of claim 8 wherein the step of sintering the green article further comprises:

heating the green article in a vacuum of less than 0.01 torr from room temperature to a first temperature between about 500 and 700° C. at a rate of temperature change of between about 100 and 300° C./hr;

maintaining the green article at said first temperature for about 0.5–1 hours;

then heating from the first temperature at rate of temperature change between about 300 and 500° C. /hr until a second temperature between about 1,400 and 1,550° C. is reached;

then holding the second temperature steady for between about 30 and 90 minutes;

then gradually lowering the temperature until it is reduced to between about 600 and 1,000° C.; and then rapidly cooling the article, using inert gases.

11. The process of claim 8 wherein the step of cleaning and smoothing all surfaces of the article further comprises tumbling or a glass beading process.

12. The process of claim 8 wherein the step of protecting said surfaces further comprises coating with epoxy or coating with nickel.

13. The process of claim 12 wherein the step of coating with nickel further comprises applying a nickel strike or electroless plating or electroplating.

14. The process of claim 8 wherein the binder is removed by solvent extraction.

15. The process of claim 8 wherein the binder is removed by heating or by catalytic action or by wicking.

16. The process of claim 8 wherein the supporting plate is alumina.

17. The process of claim 8 wherein the sintered article is selected from the group consisting of kinetic energy penetrators, hard disk drive balance weights, nuclear radiation shields, medical radiation shields, high voltage electric contacts, and high voltage electrodes.

18. An alloy, comprising:

between about 75 and 98% tungsten, by weight, and between about 2 and 25% austenitic stainless steel, by weight;

said alloy having a density between about 16 and 19 gms./cc.;

said alloy being non-magnetic; and said alloy having an electrical resistivity between about 5 and 7 ohm-cm.

19. The alloy described in claim 18 wherein said alloy is in the form of an article selected from the group consisting of kinetic energy penetrators, hard disk drive balance weights, nuclear radiation shields, medical radiation shields, high voltage electric contacts, and high voltage electrodes.

20. The alloy described in claim 18 wherein said alloy has been formed by a sintering process from powder.

* * * * *